US007455713B1

(12) United States Patent
Halalay et al.

(10) Patent No.: US 7,455,713 B1
(45) Date of Patent: Nov. 25, 2008

(54) CAVITATION PROCESS FOR TITANIUM PRODUCTS FROM PRECURSOR HALIDES

(75) Inventors: Ion C. Halalay, Grosse Pointe, MI (US); Michael P. Balogh, Novi, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 246 days.

(21) Appl. No.: 11/465,174

(22) Filed: Aug. 17, 2006

(51) Int. Cl.

| | |
|---|---|
| ***B22F 9/24*** | (2006.01) |
| ***B22F 9/30*** | (2006.01) |
| ***B01J 19/08*** | (2006.01) |
| ***B01J 19/10*** | (2006.01) |
| ***C22B 34/10*** | (2006.01) |
| ***C22B 34/12*** | (2006.01) |
| *B01D 47/02* | (2006.01) |
| *C01G 23/02* | (2006.01) |
| *B06B 1/20* | (2006.01) |

(52) U.S. Cl. ..... 75/345; 75/351; 422/127; 422/128; 423/71; 423/492; 423/497; 423/499.1; 423/DIG. 12

(58) Field of Classification Search ..... 75/345, 75/351; 420/421; 422/127, 128; 423/69–73, 423/490, 492, 497, 499.1, DIG. 12
See application file for complete search history.

(56) References Cited

U.S. PATENT DOCUMENTS

| | | | | |
|---|---|---|---|---|
| 2,205,854 | A | 6/1940 | Kroll | |
| 3,525,606 | A * | 8/1970 | Bodine | 423/1 |
| 4,606,902 | A * | 8/1986 | Ritter | 423/345 |
| 4,620,907 | A * | 11/1986 | Gomberg | 204/157.44 |
| 4,713,110 | A * | 12/1987 | Bogdanovic et al. | 75/370 |
| 5,242,557 | A * | 9/1993 | Jones et al. | 204/157.42 |
| 5,779,761 | A * | 7/1998 | Armstrong et al. | 75/370 |
| 5,958,106 | A | 9/1999 | Armstrong et al. | |
| 6,409,797 | B2 | 6/2002 | Armstrong et al. | |
| 6,746,511 | B2 * | 6/2004 | Wasmund et al. | 75/348 |
| 7,041,150 | B2 | 5/2006 | Armstrong et al. | |
| 7,329,381 | B2 * | 2/2008 | Woodfield et al. | 419/30 |
| 7,335,245 | B2 * | 2/2008 | He et al. | 75/351 |
| 7,381,240 | B2 * | 6/2008 | Carpenter et al. | 75/345 |
| 2002/0193254 | A1 * | 12/2002 | Moser et al. | 505/100 |
| 2003/0017336 | A1 * | 1/2003 | Gedanken et al. | 428/403 |
| 2006/0051288 | A1 * | 3/2006 | Tsurumi et al. | 423/608 |
| 2007/0131056 | A1 * | 6/2007 | Halalay et al. | 75/345 |

(Continued)

OTHER PUBLICATIONS

I.C. Halalay and M.P. Balogh, Sonochemical method for producing titanium metal powder, Ultrasonics Sonochemistry, vol. 15, (2008), p. 684-688.*

(Continued)

*Primary Examiner*—Roy King
*Assistant Examiner*—Mark L Shevin

(57) ABSTRACT

A titanium halide and, optionally, other precursor halides compound are reduced to a predetermined titanium product, suitably at or near ambient conditions. Titanium tetrachloride, for example, is added to an anhydrous liquid reaction medium containing one or more alkali metals or alkaline earth metals as reductants. The metal reductants are dispersed as very small globules in the liquid by cavitation of the liquid reaction medium, such as by application of high intensity ultrasonic vibrations or high-shear mixing to the reaction vessel. Continued cavitation of the liquid medium affects relatively low temperature reduction of the precursor halide(s) to produce a titanium-containing product such as titanium metal, a titanium alloy or compound, or a titanium matrix-ceramic composite material, or the like.

24 Claims, 2 Drawing Sheets

U.S. PATENT DOCUMENTS

2008/0042305 A1* 2/2008 Halalay ..... 261/151
2008/0067055 A1* 3/2008 Gunnerman ..... 204/157.15

OTHER PUBLICATIONS

I.C. Halalay and M.P. Balogh, Sonochemical Titanium, Advanced Materials & Processes, Jan. 2008, p. 41-43.*
K.S. Suslick, Sonochemistry, Science, Mar. 23, 1990, p. 1439-1445.*
F.H. Froes et al, Cost-affordable titanium; The component fabrication perspective, JOM, Jun. 2007, p. 28-31.*
G.R.B. Elliott, The continuous production of titanium powder using circulating molten salt, JOM, Sep. 1998, p. 48-49.*
D.J. Flannigan et al. Sonochemistry and sonoluminescence in ionic liquids, molten salts, and concentrated electrolyte solutions, Journal of Organometallic Chemistry, vol. 690, (2005), p. 3513-3517.*
W. Huang et al, Selective synthesis of anatase and rutile via ultrasonic irradiation, Chem. Commun. (2000), p. 1415-1416.*
D. Peters, Ultrasound in materials chemistry, J. Mater. Chem. (1996), vol. 6, No. 10, p. 1605-1618.*
The Notification of Transmittal of the International Search Report and the Written Opinion of the International Searching Authority or the Declaration for Internatio.

* cited by examiner

CAVITATION PROCESS FOR TITANIUM PRODUCTS FROM PRECURSOR HALIDES

TECHNICAL FIELD

This invention pertains to substantially ambient temperature preparation of titanium metal, titanium alloys and compounds, and titanium matrix-ceramic composite materials from hydride precursors in an anhydrous liquid medium using cavitation processing. Suitable alkali or alkaline earth metals may be dispersed by cavitation in the liquid medium for reduction of precursor halides. In an illustrative example, the practice pertains to the addition of titanium chloride or mixtures of titanium tetrachloride with other precursor halides to a cavitated liquid containing the reductant material to produce titanium metal or other titanium containing materials.

BACKGROUND OF THE INVENTION

Titanium and its metal alloys are examples of materials that currently are relatively expensive to produce. Titanium alloys can be used in forms such as castings, forgings, and sheets for preparing articles of manufacture. Titanium based materials can be formulated to provide a combination of good strength properties with relatively low weight. For example, titanium alloys are used in the manufacture of airplanes. But the usage of titanium alloys in automotive vehicles has been limited because of the cost of titanium compared to ferrous alloys and aluminum alloys with competitive properties.

Titanium-containing ores are beneficiated to obtain a suitable concentration of $TiO_2$. In a Chloride Process the titanium dioxide (often the rutile crystal form) is chlorinated in a fluidized-bed reactor in the presence of coke (carbon) to produce titanium tetrachloride ($TiCl_4$), a volatile liquid at room temperature. Traditionally, metallic titanium was produced in batch processes from the high temperature reduction of titanium tetrachloride ($TiCl_4$) with sodium or magnesium metal. Pure metallic titanium (99.9%) was first prepared in 1910 by Matthew A. Hunter by heating $TiCl_4$ with sodium in a steel bomb at 700-800° C. The first, and still the most widely used, process for producing titanium metal on an industrial scale is the Kroll Process. In the Kroll Process, magnesium at 800° C. to 900° C. is used as the reductant for $TiCl_4$ vapor and magnesium chloride is produced as the byproduct. Both of these processes produce titanium sponge and necessitate repetitive energy intensive vacuum arc remelting steps for purification of the titanium. These processes can be used for the co-production of titanium and one or more another metals (an alloy) when the alloying constituent can be introduced in the form of a suitable chloride salt (or other suitable halide salt) that undergoes the sodium or magnesium reduction reaction with the titanium tetrachloride vapor. These high temperature and energy-consuming processes yield good quality titanium metal and metal alloys but, as stated, these titanium materials are too expensive for many applications such as in components for automotive vehicles.

The Armstrong/ITP process also uses alkali metals or alkaline earth metals to reduce metal halides in the production of metals. The Armstrong process can run at lower temperatures and can operate as a continuous process for producing a metal or metal alloy (such as titanium or titanium alloy) powder. However, the projected cost of the metal is still high, too high for many automotive applications.

A lower cost process is needed for the production of titanium and other titanium containing materials such as mixtures or alloys of titanium with other metals, titanium compounds, ceramic materials containing titanium as a constituent or metal matrix material, or the like.

SUMMARY OF THE INVENTION

Titanium metal may be produced by reduction of a titanium halide (for example, titanium tetrachloride) with a reductant metal in a liquid reaction medium. The reaction may be conducted at close-to-ambient temperatures and at close-to-atmospheric pressure. The reduction of the precursor halide in the reaction medium is assisted using suitable cavitation practices, for example a sonochemical process. The process may also be used to simultaneously reduce other precursor halides with a titanium halide to produce mixtures, alloys or compounds of titanium, titanium metal matrix composite materials, or the like.

The reaction medium is an anhydrous, suitably low vapor pressure liquid that is not reactive with the precursor halide(s) or the reductant metal(s). Anhydrous liquid hydrocarbons such as decalin, tetralin, decane, dodecane, and hexadecane are examples of suitable reaction medium materials. Liquids comprising silicon-containing molecules such as polydimethylsilanes, and room temperature ionic liquids are also examples of suitable reaction medium materials. The liquid medium may be infused or covered with dry and substantially oxygen-free and water-free inert gas such as helium or argon to provide an inert atmosphere during processing.

The reductant for the precursor halide(s) is suitably one or more of the alkali or alkaline earth metals such as lithium, sodium, potassium, rubidium, cesium, magnesium, calcium, and barium. A preferred reductant is a low-melting point mixture of the reactants that can be dispersed, by application of ultrasonic vibrations to the liquid, as colloidal bodies in the liquid medium at a near-to-ambient temperature. For example, eutectic mixtures of sodium and potassium, such as 22-78 NaK, where 22-78 NaK is defined as 22 wt % Na, 78 wt % K, and 44-56 NaK, where 44-56 NaK is defined as 44 wt % Na, 56 wt % K, are liquid at about room temperature and are effective reductants for precursor halides. A titanium halide and, optionally, one or more other precursor halides are then added to the reaction medium, with its dispersed reductants, and reduced to a predetermined product. The product may be titanium metal or a mixture of titanium and other metals, or titanium containing alloy, or a titanium compound, or the like.

The process uses cavitation processes (preferably sonochemical practices) to disperse the reductant material in the liquid medium and to promote the reduction of the precursor halides. A suitable vessel containing the liquid medium is subjected to ultrasonic vibrations, using a transducer that generates sound waves in the liquid at a frequency usually greater than about 20 kilohertz. The sonic energy causes the repeated formation, growth, and collapse of tiny bubbles within the liquid, generating localized centers of very high temperature and pressure, with extremely rapid cooling rates to the bulk liquid. It is preferred that the liquid medium have a relatively low vapor pressure at processing temperatures so that the medium contributes little vapor to the high temperature regions in the cavitation bubbles. Meanwhile, the introduction of the inert gas into the liquid facilitates the formation of the cavitation bubbles with small atoms that will not be reactive at the high temperature in the bubbles.

This cavitation processing first disperses the reductant metal in the hydrocarbon liquid and then promotes the reaction of the reducing metal with the precursor halide(s) when they are brought into contact with the liquid. As stated, the reduced halide(s) yields particles of titanium, titanium alloy, or the like, depending on the composition of the halide starting materials. The metal content of the reducing medium is oxidized to a corresponding alkali metal or alkaline earth metal halide salt(s). The reaction usually proceeds over a period of minutes to several hours and usually provides an essentially quantitative yield of the constituents of the halide(s) being treated.

Thus, as an example, titanium tetrachloride liquid is passed into hexadecane containing finely dispersed 22-78 NaK and the products are titanium metal, sodium chloride, and potassium chloride.

The solids are separated from the reaction medium and the salt is separated from the titanium containing product. The temperature of the liquid medium increases somewhat from an ambient starting temperature, but typically only to a temperature of the order of 60° C. to about 100° C. The reaction may be conducted as a batch process or on a continuous basis.

The titanium-containing products are often produced initially as very small particles. Often the product is amorphous or of very small crystal size.

An obvious advantage of this practice for producing titanium or titanium containing materials is that the process may be conducted at temperatures that are relatively low, for example at close to ambient temperatures, and with relatively low consumption of energy.

DESCRIPTION OF PREFERRED EMBODIMENTS

Figure 1:
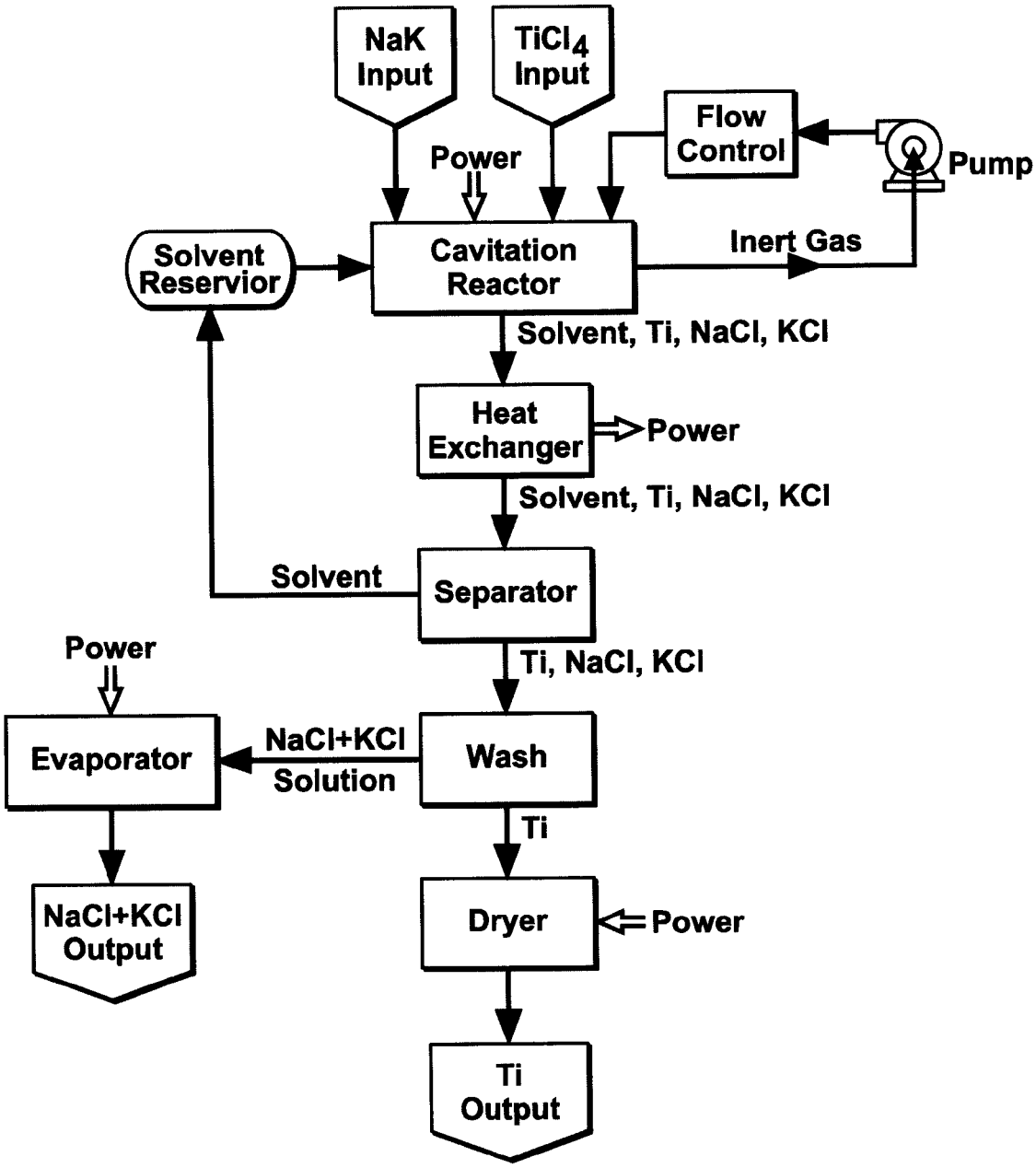
FIG. 1 is a flow diagram illustrating an embodiment of the invention as it is applied to the production of titanium metal starting with titanium tetrachloride as the halide precursor.

This invention utilizes cavitation (e.g., sonochemistry or high-shear mixing) to promote the reduction of precursor halides to useful titanium-containing products. In the practice of sonochemistry, liquids are subjected to high intensity sound or ultrasound (sonic frequencies above twenty kilohertz, above the range of human hearing). The liquid is contained in a suitable vessel that is actuated by one or more ultrasonic transducers or the like. Each transducer converts alternating current energy above twenty kilohertz to mechanical vibrations of about the same frequency. The transducer usually utilizes a magnetostrictive or piezoelectric material to convert alternating current to mechanical vibrations.

When ultrasonic vibrations of suitable intensity are applied, the energy is transmitted through the walls of the vessel to the liquid. The ultrasonic energy causes the repeated formation, growth, and collapse of tiny cavitation bubbles within the liquid, generating localized centers of very high temperature and pressure, with extremely high cooling rates to the bulk liquid. It is estimated that the local temperature and pressure within the bubbles can reach 5000 K and two kilobars, respectively. Ultrasound propagates by a series of compressions and rarefactions induced in the liquid medium through which it passes. At sufficiently high power, the forces generated during the rarefaction cycles exceed the attractive forces between the molecules of the liquid and cavitation bubbles will form. The bubbles will then grow during subsequent acoustic cycles by a process known as rectified diffusion, i.e. small amounts of vapor and gas from the medium enter the bubble during its expansion phase and are not fully expelled during compression. The bubbles grow until they reach an unstable size, then collapse during a succeeding compression (i.e. acoustic half-cycle), with the release of energy for chemical and mechanical effects. The spherical bubble or vapor cavity may have a diameter of about 0.2 to about 200 micrometers and experience a momentary temperature of about 5000 K. The vapor cavity is enclosed by a liquid shell which, in turn, is immersed in the bulk liquid. The liquid shell may have a thickness of about 0.02 to about 2 micrometers and a momentary temperature of about 2,000 K. The bulk liquid may be gradually heated by the sonochemical activity. Assuming that the bulk liquid is initially at a low temperature of, e.g., 298 K, it may reach a temperature of up to 670 K during prolonged sonochemical processing.

Chemical reactions can occur in two distinct regions of the medium: (1) inside the vapor cavity, i.e. the bubble proper, and (2) inside the hot liquid shell surrounding which surrounds the bubble. The narrow width of the hot liquid shell and the large temperature difference between the vapor cavity and surrounding liquid (order of 5,000 K) lead to extremely steep temperature gradients, which in turn translate into cooling rates of the order of $10^9$ K/s. Such conditions will lead to the formation of metastable—sometimes amorphous—metals, alloys and compounds.

The chemical reduction of metal chlorides with alkali metals and magnesium has been practiced at very high temperatures, for example in the commercial production of titanium metal. But this invention permits the reduction of suitable titanium halide, and optionally other precursor halides, at lower temperatures than traditionally used for the synthesis of a particular product. In the practice of this invention sonochemistry is used to promote the reduction of precursor halides in an inert, anhydrous liquid reaction medium. Preferably, the reaction medium is a low vapor pressure anhydrous hydrocarbon, such as decalin, tetralin, decane, dodecane, and hexadecane. Some of these liquids have a melting point well below 0° C. and a boiling point well above 100° C. Thus, they provide a broad temperature range as a reaction medium extending below and above typical ambient temperatures. Low vapor pressure is preferred so as to minimize the presence of vapor from the liquid reaction medium in the cavitation bubbles. For some embodiments hydrocarbons such as xylene and toluene with moderate vapor pressure may also be suitable. The water content of the anhydrous liquid reaction medium is suitably less than 100 ppm, preferably below 10 ppm.

The reduction of a titanium halide by an alkali or alkali-earth metal to form a desired titanium-containing material and alkali metal or alkali-earth metal chlorides proceeds exothermically. The heat released in a given reaction for a given amount of precursors can be determined through thermochemical calculations. In the case of batch processing, the amount of liquid reaction medium (sometimes a solvent) needed for the reaction is determined from the heat released in the reaction and from the specific heat of the liquid used as reaction medium. Typically, one chooses an amount of liquid so that the temperature increase at the end of the reaction does not exceed a predetermined temperature limit deemed to be safe or desirable. This procedure can be adapted for continuous processing, provided that the reaction apparatus is equipped with a heat exchanger. In this case one must choose a precursor addition rate such that the heat release rate during the reduction reaction(s) is balanced by the heat removal rate of the heat exchanger.

In general, it may be preferred to start a practice of the process with the reaction medium at ambient temperature or near to ambient temperature. It is found that dispersion of the alkali or alkali-earth metal reductants in the reaction medium, with the aid of ultrasound (or other cavitation method) causes the temperature of the medium to rise, typically by 10° C. to 30° C., above its initial temperature. Addition of the titanium halide under cavitating conditions, causes the temperature in the reaction vessel to increase steadily, so that the temperature of the reaction medium at the end of the reaction reaches typically to a temperature between 70° C. to 100° C. Specific examples of the practice of the invention are described below. In these examples of relatively small reaction volumes, no attempt was made to control the temperature of the reaction medium as it increased from room temperature. However, controlling the average temperature of the reaction medium may be desirable or necessary when the goal is to achieve a predetermined particle size and/or morphology for the product. Typically, low average reaction medium temperatures will yield smaller titanium product particles which are generally characterized by a relatively high specific surface area and relatively high chemical reactivity. When formed in a relatively low temperature reaction medium the titanium or titanium-containing particles may be amorphous or have a very fine crystal structure. On the other hand relatively high average reaction medium temperatures favor the formation of larger particles with a lower specific surface area and lower chemical reactivity. These higher temperature reaction conditions sometimes produce crystalline products and in the form of aggregated particles. Suitable ranges include, for example from about −20° C. to about 300° C.

Besides the temperature of the reaction medium, the power input per unit area is another factor that determines product particle size and morphology. Should a given particle size and morphology be the desired outcome of the reaction, then both the reaction temperature and input power must be adjusted to achieve this goal (after choosing a suitable solvent or reaction medium). However, if a low cost is desired, then one would like to operate close to the threshold power for the reaction(s). This threshold power may be determined experimentally, by running successive reactions at decreasing power levels, until the reaction stops or the overall processing time is unacceptably long. The ultrasonic energy input is of low or moderate level.

In the example of the reduction of titanium tetrachloride at laboratory scale as described below in this specification, the energy level of the transducer was 0.25 $W/cm^2$ of transducer-engaged surface of the reaction flask or vessel.

The sonochemical reaction is practiced using continuous infusion or sparging of the reaction medium with an inert gas, suitably helium or argon. The inert gas promotes cavitation and provides a protective blanket for the liquid reaction medium. To the extent that atoms or molecules of the inert gas enter the high temperature regime of the cavitation bubbles these chemical species are more likely to remain unaltered and not contaminate desired reaction products. The pore diameter of the sparging elements is typically in the range of about 0.5 μm to 200 μm.

Alkali metals and alkaline earth metals (especially magnesium) are available as reduction agents. However, either of the two eutectic alloys of sodium and potassium, 22-78 NaK and 44-56 NaK, is preferred because each is liquid at typical ambient conditions and easily dispersed as colloids (or finer) with ultrasonic energy in anhydrous liquid hydrocarbon media. It is preferred to use reducing metals in a form that is readily dispersed in the liquid reaction medium. Further, it is generally preferred to disperse the reductant metal(s) in the reaction medium before adding the halide precursor.

Precursor halides that are gases, or volatile and reactive liquids, or solids are reduced sonochemically. An example of a precursor gas is boron trichloride. Examples of liquid precursor halides are titanium tetrachloride ($TiCl_4$), vanadium tetrachloride ($VCl_4$), carbon tetrachloride, and silicon chlorides ($SiCl_4$ and $Si_2Cl_6$). Solid precursor halides that are not completely insoluble in the liquid sonochemical reaction medium are also suitable. Examples include platinum dichloride ($PtCl_2$), platinum dibromide ($PtBr_2$), Platinum diiodide ($PtI_2$), aluminum trichloride ($AlCl_3$), titanium trichloride ($TiCl_3$), platinum tetrachloride ($PtCl_4$) and zirconium tetrachloride, ($ZrCl_4$).

Amorphous or nanocrystalline products have been produced that include, as examples, Ti, $TiSi_2$, and PtTi.

Figure 2:
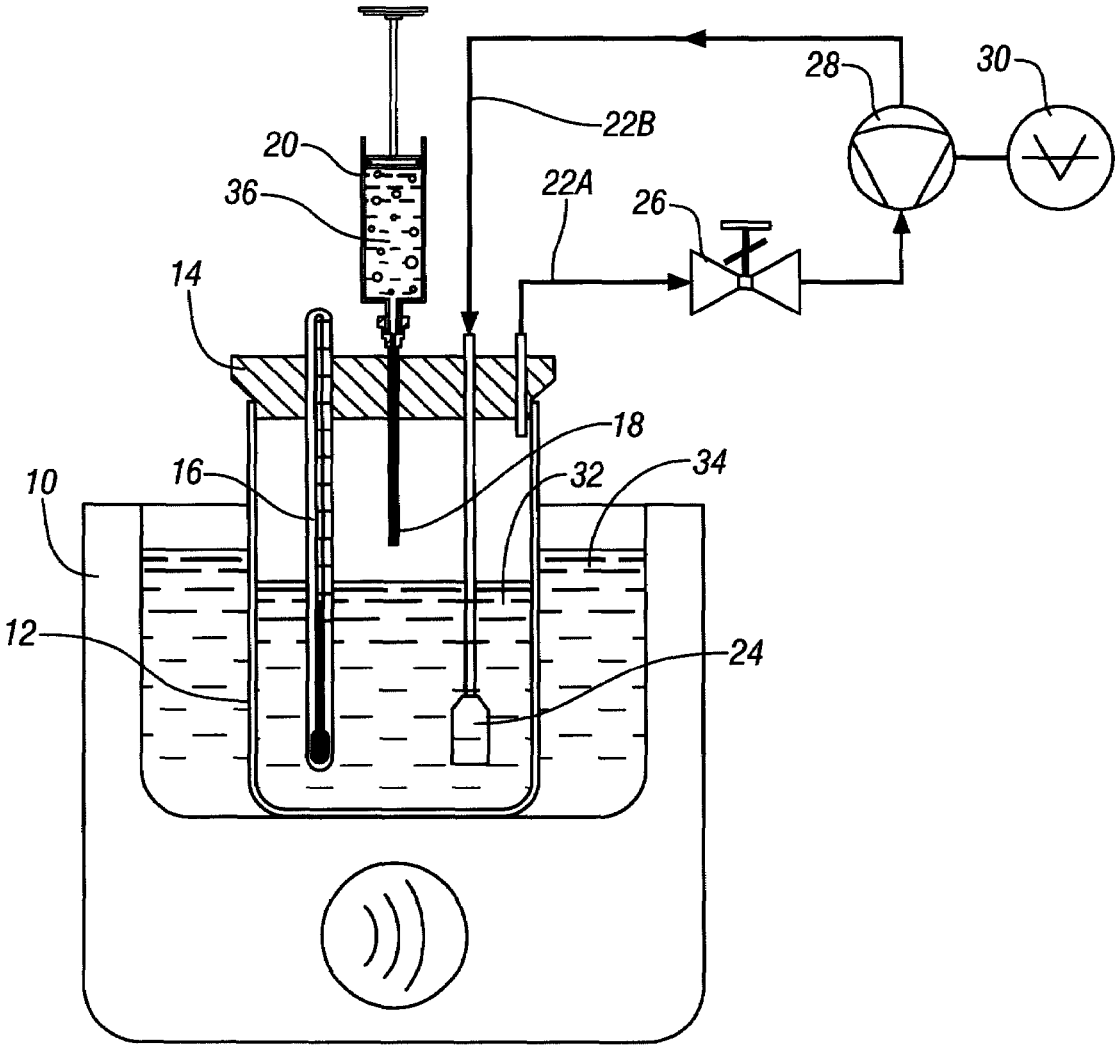
FIG. 2 is a schematic illustration of apparatus for the sonochemical reduction of titanium chloride using a mixture of sodium and potassium dispersed in a hydrocarbon liquid.

An embodiment of the invention will be illustrated using volatile liquid titanium tetrachloride as a representative titanium halide, hexadecane as a representative inert, low vapor pressure, hydrocarbon liquid, and a low melting point mixture (a eutectic mixture, 22-78 NaK) of sodium and potassium as the reductant. The process will be illustrated with reference to the drawing figures. FIG. 1 is a flow diagram for the formation and separation of titanium metal product and FIG. 2 is a schematic illustration of reactor apparatus for the process.

The flow diagram of FIG. 1 generally illustrates processing steps for the production of a predetermined product by reduction of a precursor halide. In this example the precursor halide is titanium tetrachloride for the production of titanium metal. The process may be practiced as a batch process or a continuous process.

Referring to FIG. 1, a Cavitation Reactor is filled with a suitable quantity of a liquid reaction medium from a Solvent Reservoir. Cavitation conditions are created in the liquid medium of the Cavitation Reservoir using Power from a suitable ultrasonic transducer or the like. An inert gas, such as argon or helium, is sparged through the liquid reaction medium in the Cavitation Reactor using a Pump and Flow Control for the inert gas flow. As illustrated it is preferred that the inert gas be circulated to and from the Cavitation reactor in a closed loop to retain volatile constituents in the reactor.

A suitable amount of a reductant, here a liquid mixture of sodium and potassium metals (NaK), is added to the liquid reaction medium in the Cavitation Reactor from NaK Input source. The contents of the Cavitation Reactor may be subjected to a Heat Exchanger for the removal of energy (labeled Power in FIG. 1) and temperature control.

The product stream is subjected to a separation process in Separator. In the separation step, the solids containing titanium, sodium chloride, and potassium chloride are removed from the hexadecane reaction medium which is recycled as Solvent to the Solvent Reservoir. The solids (Ti, NaCl, and KCl) are washed (Wash) to remove the halide salts (as Solution of NaCl+KCl). Titanium metal is recovered from the Wash step and sent to a Power consuming dryer for obtaining pure dry titanium metal (Ti Output). The solution or suspension of sodium chloride and potassium chloride are processed in a power-consuming Evaporator for recovery and possible recycling of these salts (NaCl+KCl Output).

The above illustrated process is applicable with minor suitable modifications to many titanium-containing products that may be obtained by many combining a titanium halide precursor compound with other precursor halide materials selected for making specific mixtures or compounds of titanium with other elements.

The above process was conducted in laboratory-scale apparatus as illustrated in FIG. 2.

A reaction vessel 12 was partially immersed in the vibration bath 34 of an ultrasonic generator 10. Ultrasonic generator vibration bath 34 contained an anhydrous mixture of decalin and hexadecane.

The reaction vessel 12 contained a liquid reaction medium 32 which in this example was hexadecane. A quantity of liquid 22-78 NaK eutectic alloy was dispersed as colloidal droplets in the hexadecane reaction medium 32. Reaction vessel 12 (a transparent glass vessel) was closed with a hermetic feed-through cover 14. The vessel contained a thermometer 16. The hexadecane reaction medium 32 was infused with very dry and oxygen-free argon through feed-through closure cover 14 using gas feed line 22B, sparger nozzle 24, gas return line 22A, needle valve 26, and diaphragm gas pump 26. The pressure of the argon atmosphere was controlled using needle valve 28 and pressure gauge 30.

Activation of the ultrasonic generator 10 for about twenty minutes dispersed the sodium-potassium mixture as colloidal droplets in the initially clear hexadecane reaction medium 32. The droplets of reductant metal, the cavitation bubbles, and the argon gas bubbles were all very small and are not illustrated in FIG. 2. The colloidal suspension became opaque blue-gray. The action of the ultrasonic generator 10 was continued and liquid titanium tetrachloride 36 was slowly added to the reaction medium 32 from syringe 20 through addition tube 18 inserted through hermetic feed-through cover 14. The amount of titanium tetrachloride added was determined so as to be chemically equivalent to the amount of sodium/potassium reductant in accordance with the following equation, $TiCl_4+4\ Na_{0.32}K_{0.68}\rightarrow Ti+1.28\ NaCl+2.72\ KCl$, where $Na_{0.32}K_{0.68}$ is defined as a Na mole fraction equal to 0.32 and a K mole fraction equal to 0.68.

In this example 1.252 grams (35.20 mmol) of 22-78 NaK was dispersed in 125 ml of hexadecane. Then 0.566 g (8.80 mmol) of $TiCl_4$ was added to the dispersed reductant metal.

As the reaction proceeded, the contents of the reaction vessel turned black. Titanium chloride was added over a period of about thirty minutes. The temperature of the materials in the un-cooled vessel (except by heat loss to ambient air) increased from about 25° C. to about 80° C. due to the input of sonic energy and the exothermic reaction. The total insonation time was sixty minutes. The ultrasonic generator 10 was turned off and contents of the reaction vessel 12 were allowed to settle.

After about an hour of product particle sedimentation the clear solvent above the black powder was removed by decantation. The solids were washed with toluene to remove residual hexadecane, and the mixture was centrifuged. The wash liquid was removed by decanting and a second wash and separation procedure with pentane was performed followed by drying in a vacuum oven. The salts were identified as sodium chloride and potassium chloride by x-ray diffraction and it was determined that they had been formed in quantitative amounts in the reduction reaction. The other product of the reduction of titanium tetrachloride was substantially amorphous titanium metal.

The reaction medium-free solids were then washed with formamide to separate sodium chloride and potassium chloride from the titanium product. An anhydrous solvent for the metal chlorides was used to prevent reaction with any unconsumed titanium chloride. Water may be used to remove alkali metal halide salts or alkaline earth metal salts in other embodiments of the invention.

The product powder was separated from the formamide solution of the sodium and potassium salts by centrifuging. The amorphous titanium metal was heated in a vacuum oven to remove residual solvents and wash fluids. The metal can then be further heated in a vacuum oven or other suitable heating apparatus for heat treatment of the metal product. For example, the metal product may be annealed, crystallized, melted and cast, or the like.

The above described reaction apparatus may be modified for temperature control of the reaction vessel and/or of the circulated argon or other inert gas atmosphere. Further, the circulated inert gas may be scrubbed as it is recirculated to and from the reaction vessel to remove oxygen and liquid hydrocarbon reaction medium material. The scrubbing is also used to return volatile reactants to the reactor.

The illustrated embodiment produced titanium metal from a precursor halide charge material which contained only titanium tetrachloride. Of course, titanium has many useful applications in many industries. The titanium product could have been formed stating with other titanium halides. And the product of the titanium halide reduction can be annealed, treated by powder metallurgy methods, hot or cold working, or other processing to convert it to a metallurgical form required for an intended application.

The described process may also be practiced by using a precursor halide mixture comprising titanium halide and one or more other precursor halides in smaller portion to form a reduction product that is a mixture of titanium and, for example, aluminum and vanadium preparatory to forming an titanium-aluminum-vanadium alloy of titanium. Also titanium compounds, such as titanium silicide ($TiSi_2$), may be formed by using a mixture of halides such as titanium tetrachloride and silicon tetrachloride.

Titanium disilicide powder has been produced in accordance with the reaction, $TiCl_4+2\ SiCl_4+12\ Na_{0.32}K_{0.68}\rightarrow TiSi_2+3.84\ NaCl+8.16\ KCl$. The liquid reaction medium was 150 mL hexadecane at ambient temperature. The sodium/potassium mixture was dispersed in the amount of 1.274 g (35.81 mmol). $TiCl_4$ was added in the amount of 0.566 g (0.325 mL, 2.98 mmol) together with $SiCl_4$ in the amount of 1.014 g (0.660 mL, 5.97 mmol). The total mass of precursors was 2.85 g and the total mass of products was 2.81 g. The insonation time (after NaK dispersion) was 60 minutes.

Thus, while a few specific embodiments have been described it is apparent the disclosed sonochemical (cavitational) practices for the reduction of titanium halides, alone or in combination with other precursor halides, are of broad application in producing useful titanium-containing materials.

The invention claimed is:

1. A method of reducing a precursor halide composition comprising a titanium halide to yield a predetermined titanium-containing product, the method comprising:

circulating a dry inert gas through an anhydrous liquid reaction medium and inducing cavitation in the liquid reaction medium; and mixing the precursor halide composition with a reductant composition in the liquid reaction medium during the cavitation to reduce the precursor halide composition to the predetermined titanium-containing product, the reductant composition consisting essentially of at least one of an alkali metal and/or an alkaline earth metal(s), the reductant composition being converted to the halide salt of the alkali metal and/or alkaline earth metal upon reaction with the precursor halide composition.

2. A method of reducing a precursor halide composition as recited in claim 1 in which the precursor halide composition consists essentially of a titanium halide and the product is titanium metal.

3. A method of reducing a precursor halide composition as recited in claim 1 in which the titanium halide is combined with the halide of at least one other metal and the product is a mixture or alloy of the other metal with titanium.

4. A method of reducing a precursor halide composition as recited in claim 1 in which the titanium halide is combined with the halide of a non-metal and the predetermined product comprises titanium and the non-metal.

5. A method of reducing a precursor halide composition as recited in claim 1 in which the liquid reaction medium is maintained at a temperature in the range of about −80° C. to about 300° C. during the cavitation and reduction of the precursor halide(s) to the predetermined product.

6. A method of reducing a precursor halide composition as recited in claim 1 in which the anhydrous liquid is a hydrocarbon liquid, a liquid comprising a silicon-containing compound, or an ionic liquid.

7. A method of reducing a precursor halide composition as recited in claim 1 in which the anhydrous liquid is a hydrocarbon liquid selected from the group consisting of decalin, tetralin, decane, dodecane, and hexadecane.

8. A method of reducing a precursor halide composition as recited in claim 1 in which the reductant composition consists essentially of a mixture of sodium and potassium that is liquid at temperatures below about 30° C.

9. A method of reducing a precursor halide composition as recited in claim 1 in which the reductant compound is initially dispersed in the liquid reaction medium and the precursor halide compound is thereafter added to the liquid reaction medium.

10. A method of reducing a precursor halide composition as recited in claim 1 in which the amount of liquid reaction medium is predetermined based on the heat of reaction of the precursor halide and the reductant material.

11. A method of reducing a precursor halide composition as recited in claim 1 in which substantially stoichiometric proportions of precursor halide(s) and reductant composition are reacted.

12. A method of reducing a precursor halide composition as recited in claim 1 in which inert gas is pumped through the liquid reaction medium in a closed circuit path.

13. A method of reducing a precursor halide composition comprising a titanium halide to yield a predetermined titanium-containing product, the method comprising:

forming a reduction reaction medium for the precursor halide composition by dispersing a reductant composition for the halide(s) in an anhydrous liquid that is non-reactive with the reductant composition using vibrations to affect cavitation in the liquid, the reductant composition consisting essentially of at least one of an alkali metal and/or alkaline earth metal;

circulating a dry inert gas through the reduction reaction medium to assist cavitation in the medium and to reduce the oxygen content of the reduction reaction medium; and, while continuing the vibrations, adding the precursor halide composition to the reduction reaction medium to reduce the precursor halide composition to the predetermined titanium-containing product and to concurrently form a corresponding halide salt of the alkali metal and/or alkaline earth metal(s).

14. A method of reducing a precursor halide composition as recited in claim 13 in which the precursor halide composition consists essentially of a titanium halide and the product is titanium metal.

15. A method of reducing a precursor halide composition as recited in claim 13 in which the titanium halide is combined with the halide of at least one other metal and the product is a mixture or alloy of the other metal with titanium metal.

16. A method of reducing a precursor halide composition as recited in claim 13 in which the titanium halide is combined with the halide of a non-metal and the predetermined product comprises titanium and the non-metal.

17. A method of reducing a precursor halide composition as recited in claim 13 in which the anhydrous liquid is a hydrocarbon liquid, a liquid containing silicon, or an ionic liquid.

18. A method of reducing a precursor halide composition as recited in claim 13 in which the precursor halide composition comprises titanium tetrachloride.

19. A method of reducing a precursor halide composition as recited in claim 13 in which the precursor halide composition comprises titanium tetrachloride and vanadium chloride and the predetermined titanium-containing product comprise a mixture of titanium and vanadium.

20. A method of reducing a precursor halide composition as recited in claim 13 in which a titanium chloride is combined with a silicon chloride and the product comprises titanium disilicide.

21. A method of reducing a precursor halide composition as recited in claim 13 further comprising dissolving the alkali or alkaline earth metal halide in a solvent to separate it from the predetermined product.

22. A method of reducing a precursor halide composition to yield a predetermined product as recited in claim 21, the method further comprising removing solvent from the predetermined product by heating the product in a vacuum oven.

23. A method of reducing a precursor halide composition to yield a predetermined product as recited in claim 13, the method further comprising annealing or melting the titanium-containing product by heating the product in a vacuum oven at a temperature in the range of about 573 K to about 2100 K.

24. A method of reducing a precursor halide composition comprising titanium tetrachloride to yield a predetermined titanium-containing product, the method comprising:

forming a reduction reaction medium for the precursor halide composition by dispersing a reductant composition for the halide(s) in an anhydrous liquid that is non-reactive with the reductant composition using vibrations to affect cavitation in the liquid, the reductant composition consisting essentially of a mixture of sodium and potassium that is liquid at temperatures below about 30° C.;

circulating a dry inert gas through the reduction reaction medium to assist cavitation in the medium and to reduce the oxygen content and water content of the reduction reaction medium; and, while continuing the vibrations, adding the precursor halide composition to the reduction reaction medium to reduce the precursor halide composition to the predetermined titanium-containing product and to concurrently form corresponding halide salts of the sodium and potassium; and separating the predetermined product from the halide salts of sodium and potassium.

* * * * *